US008306248B2

(12) United States Patent
DiGiovanni et al.

(10) Patent No.: US 8,306,248 B2
(45) Date of Patent: Nov. 6, 2012

(54) APPARATUS, SYSTEMS AND METHODS FOR RELIEVING TINNITUS, HYPERACUSIS AND/OR HEARING LOSS

(76) Inventors: Jeffrey J. DiGiovanni, Athens, OH (US); Stephen Rizzo, Kingston, OH (US)

( * ) Notice: Subject to any disclaimer, the term of this patent is extended or adjusted under 35 U.S.C. 154(b) by 1333 days.

(21) Appl. No.: 11/599,719

(22) Filed: Nov. 14, 2006

(65) Prior Publication Data

US 2007/0133832 A1 Jun. 14, 2007

Related U.S. Application Data

(60) Provisional application No. 60/736,513, filed on Nov. 14, 2005, provisional application No. 60/812,484, filed on Jun. 9, 2006, provisional application No. 60/836,294, filed on Aug. 8, 2006.

(51) Int. Cl.
*H04R 25/00* (2006.01)

(52) U.S. Cl. ..... 381/315; 381/23.1; 381/312

(58) Field of Classification Search ..... 381/312–331; 600/28

See application file for complete search history.

(56) References Cited

U.S. PATENT DOCUMENTS

| | | | | |
|---|---|---|---|---|
| 5,479,522 | A | 12/1995 | Lindemann et al. | |
| 6,047,074 | A * | 4/2000 | Zoels et al. | 381/313 |
| 6,366,677 | B1 * | 4/2002 | Sigwanz et al. | 381/314 |
| 7,369,671 | B2 * | 5/2008 | Sacha et al. | 381/331 |

FOREIGN PATENT DOCUMENTS

| | | | |
|---|---|---|---|
| EP | 0 335 542 | A2 | 10/1989 |
| EP | 335542 | A2 * | 10/1989 |
| EP | 0 941 014 | A2 | 9/1999 |
| WO | WO 2004/110099 | A2 | 12/2004 |
| WO | WO 2004110099 | A2 * | 12/2004 |

OTHER PUBLICATIONS

Patent Cooperation Treaty, International Search Report, International Application No. PCT/US2006/044286, mailed Mar. 30, 2007, 5 pages.

* cited by examiner

*Primary Examiner* — Yuwen Pan
*Assistant Examiner* — Matthew Eason
(74) *Attorney, Agent, or Firm* — Standley Law Group LLP

(57) ABSTRACT

A system and method for relieving tinnitus, hyperacusis, and/or hearing loss is described. One method described includes manipulating an audio signal, associating an audio signal with synchronization information, and transmitting the audio signal and associated synchronization information to a first ear level device and a second ear level device. The method further includes outputting the audio signal substantially simultaneously in the first ear level device and the second ear level device, based at least in part on the synchronization information.

31 Claims, 13 Drawing Sheets

Ear Level Device *1302*

APPARATUS, SYSTEMS AND METHODS FOR RELIEVING TINNITUS, HYPERACUSIS AND/OR HEARING LOSS

RELATED APPLICATIONS

This application claims priority to U.S. Provisional Patent Application Ser. Nos. 60/736,513, filed Nov. 14, 2005; 60/812,484, filed Jun. 9, 2006; and 60/836,294, filed Aug. 8, 2006; the entirety of each of which are hereby incorporated herein by reference.

FIELD OF THE INVENTION

The present invention generally relates to medical apparatus, systems, and methods. The present invention more particularly relates to medical apparatus, systems, and methods advantageous for relieving hearing related conditions, including tinnitus, hyperacusis and/or hearing loss.

BACKGROUND

Tinnitus is the sensation of a sound in the ear or head that is not being produced by an external source. Approximately 12 million hearing and hearing-impaired individuals in the United States suffer from some form of tinnitus. More than two-million Americans are debilitated with tinnitus to the point where it affects their daily functions, including job performance, and personal relationships. Furthermore, the prevalence of tinnitus increases with age, and the demand for tinnitus treatment will significantly increase over the next thirty years.

Hyperacusis, on the other hand, may be defined as a reduced tolerance to normal environmental sounds. Hyperacusis sufferers range from someone mildly uncomfortable in a normal social setting to someone profoundly discomforted by many of the sounds encountered in daily life. Individuals with initially reduced loudness discomfort levels (LDLs) generally exhibit a reduced dynamic range, which is the intensity range over which we hear sound, from the softest sound perceptible to the loudest sound tolerable. The reduced dynamic range usually manifests in a reduced tolerance to more intense sounds, even those that would be considered moderately soft to normal listeners.

Many individuals who suffer from tinnitus and/or hyperacusis may also suffer from some form of hearing loss.

It would be advantageous to have new apparatus, systems and methods for treating and/or relieving the symptoms of tinnitus, hyperacusis, and/or hearing loss. It would also be advantageous to have new apparatus, system and methods for treating, and/or relieving the symptoms of tinnitus, hyperacusis, and/or hearing loss and that also treat hearing loss.

SUMMARY

The present invention comprises apparatus, systems, methods and/or computer readable media for relieving tinnitus, hyperacusis, and/or hearing loss.

One embodiment of the present invention comprises an ear level device. The ear level device may comprise different form factors and different component parts. In an embodiment, an ear level device provides audio signals to a patient wearing the device. The audio signals may form a part of a tinnitus retraining therapy treatment regime for a patient. In an embodiment, an ear level device further comprises components for treating hearing loss in a patient.

One embodiment of the present invention comprises a signal generating device that generates audio signals. The audio signals may be transmitted to an ear level device of the present invention.

One embodiment of the present invention comprises a system. The system comprises an ear level device. The system may further comprise a signal generator and hardware and/or software components for communication among component parts.

Another embodiment of the present invention comprises a method for treating one or more audio related conditions, including, but not limited to, tinnitus, hyperacusis and/or hearing loss. A method of one embodiment of the present invention may provide substantially immediate therapeutic relief to a patient suffering from tinnitus, hyperacusis, and/or hearing loss. A method of one embodiment of the present invention may, in addition, or in the alternative, provide long term relief to a patient suffering from tinnitus, hyperacusis, and/or hearing loss.

Embodiments of the present invention have many advantages over current devices, systems and methods. For instance, an advantage of some embodiments of the present invention may be that an embodiment of the present invention may provide relief to a patient suffering from tinnitus, hyperacusis and/or hearing loss. Additional advantages will become apparent to those of ordinary skill in the art from the description contained herein.

BRIEF DESCRIPTION OF THE DRAWINGS

These and other features, aspects, and advantages of the present invention are better understood when the following Detailed Description is read with reference to the accompanying drawings, which constitute part of this specification, wherein.

DETAILED DESCRIPTION

Figure 1:
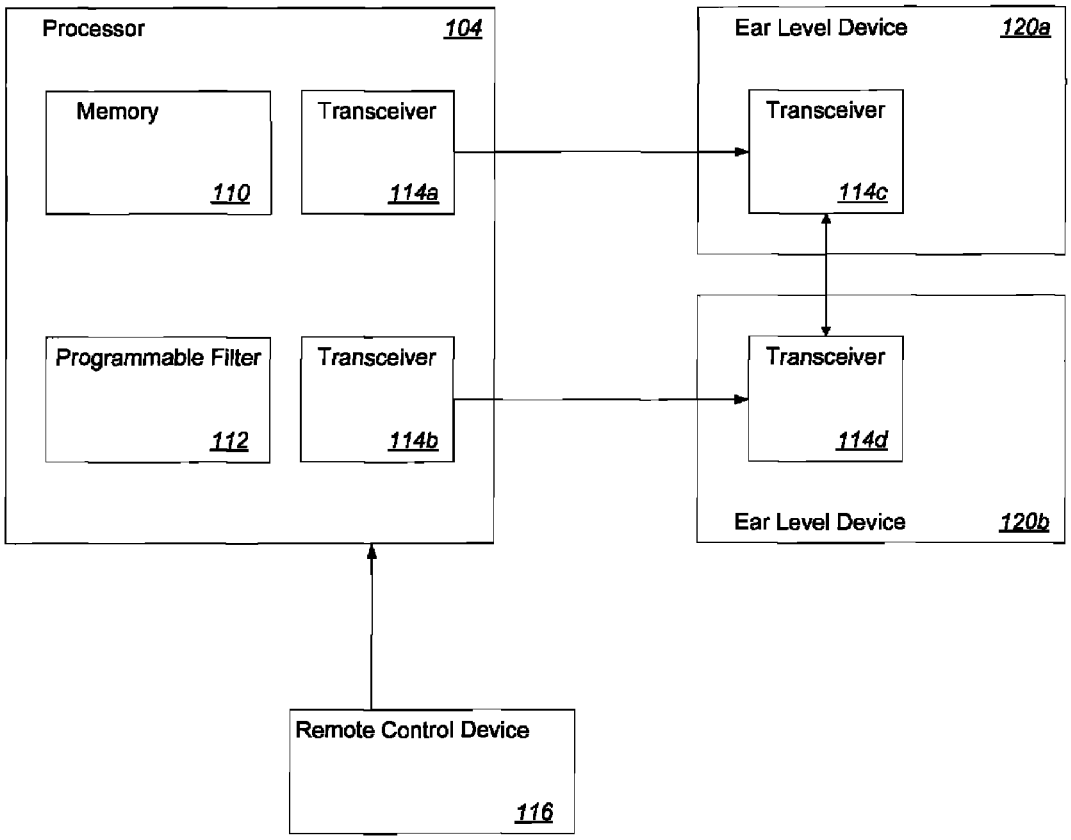
FIG. 1 is a block diagram illustrating one embodiment of the tinnitus, hyperacusis, and/or hearing loss relieving device.

Embodiments of this invention provide apparatus, systems and methods for relieving tinnitus, hyperacusis, and/or hearing loss.

In one embodiment of the present invention, an apparatus comprises an ear level device comprising a receiver. The receiver may be capable of communicating with a signal generator to receive signals that are transmitted through the ear level device and thereby heard by a person wearing the ear level device. The signals may comprise audio signals. The signals may be transmitted by radio frequency, WIFI, Bluetooth, and/or similar technologies. The signals may be encoded or otherwise modified to avoid interference with other radio frequencies. The apparatus may further comprise a memory. The memory may comprise a random access memory (RAM) or a read only memory (ROM). In an embodiment, the memory comprises flash RAM. In an embodiment the memory stores signals that may be retrieved for playback through the ear level device. The apparatus may further comprise executable software code for carrying out instructions relating to the receiver, the reception of signals, the playback of signals, and the like. In an embodiment, the apparatus comprises a power source. In an embodiment, a power source comprises a DC power source. Suitable DC power sources include a battery, such as a lithium battery, silver nitride battery, and/or batteries known in the art.

In one embodiment, an ear level device comprises a monitor such as a headphone. In one embodiment, the headphone comprises a single ear monitor. In another embodiment, the headphone comprises a dual (two) ear monitor. The headphone may be wired or wireless as described further below. Examples of headphones/monitors include in ear monitors (IEM), closed monitors/headphones, open monitors/headphones, earbud headphones, and the like known in the headphone/monitor art.

In one embodiment, an ear level device has a form factor substantially similar to a hearing aid form factor. Suitable form factors include those known in the hearing aid art and comprise: CIC (Completely in the Canal); ITC (In the Canal); ITE (In the Ear); BTE (Behind the Ear). In one embodiment, an ear level device comprises one of the following devices: CIC; ITC; ITE or BTE, An ear level device may be colored to match a patient's skin tone and/or hair color. The ear level device may be sized and fit to an individual in a manner similar to the manner used by audiologists to size and fit hearing aids.

A CIC device will generally be the smallest type of device and may be almost invisible in the ear. CICs will generally be custom made for an individual and for each ear. In one embodiment of the present invention, part or all of the components are housed in a small case that fits far into the ear canal. The fit may take advantage of the ear's own natural sound-collecting design and may allow for convenient usage of telephone handsets or other ear monitors.

An ITC device may be a little bigger than a CIC device however will also generally fit into the ear canal. An ITC device may permit the use of a battery having larger dimensions.

An ITE device is generally slightly larger than an ITC or CIC device and may be designed to fit an external portion of the ear. An ITE device, due to its size, may be able to accommodate larger sized components and more features. An ITE device may be easier to handle by a person having reduced dexterity.

In a BTE device, components may be housed in a case that fits behind the ear. Tubing and an ear mold, that may be custom fit for a patient, direct the sound to the ear canal. BTE devices may incorporate larger sized components and a larger sized battery.

In one embodiment, an ear level device is configured to work with an external device such as a telephone, mobile telephone, audio playback device, pda, gaming device or similar device.

In one embodiment, an apparatus of the present invention comprises a transceiver in addition to, or instead of the receiver. The transceiver receives and/or transmits signals to external devices. The transceiver receives and/or transmits signals to external devices, apparatus. In one embodiment, an apparatus of the present invention comprises a tinnitus, hyperacusis, and/or hearing loss device and method that may reduce the effects of tinnitus, hyperacusis, and/or hearing loss. For example, embodiments of the present invention may provide a convenient, individually customized sound delivery method for people who suffer from hearing disorders such as tinnitus or hyperacusis. Such embodiments may allow sufferers of tinnitus, hyperacusis, and/or hearing loss to listen to the surrounding environment or complex, pleasing nature sounds, such as rushing wind, trickling water, or falling rain, played simultaneously to each ear.

Embodiments of the present invention may provide a synchronization method to ensure that two separate hearing aid devices are activated simultaneously, or substantially simultaneously, to allow a stored audio signal to be reproduced in the exact timeframe, such that program changes occur simultaneously, and the sound output to each ear is similar and replicates auditory perception important for tinnitus-retraining and/or hyperacusis relief. The synchronization method may provide for additional information to be transmitted from one hearing aid device to the other hearing aid device. This additional synchronization information may include data regarding changes made to one hearing aid device to be made in the other hearing aid device. For example, the data may signal the initiation of audio signal reproduction, or report the audio track to be played. A substantially simultaneous activation may comprise an activation in which the period of time between activation of the first ear level device and the second ear level device is so short as to be undetectable by a user.

In one embodiment, the device reproduces audio signals to the user according to specific filter characteristics. These filter characteristics may include frequency, intensity, and spectrum. Over time, these filter characteristics may change. For example, these changes may be in response to data collected by an audiologist during a hyperacusis or tinnitus assessment, (such as audiograms, pitch, sound type, loudness, and functional dynamic range), in order to program the device using parameters most appropriate for an individual user. The device may also use threshold and loudness measurements, such as most comfortable loudness ("MCL") to program the frequency and intensity parameters. Embodiments of the present invention may interface with industry-standard fitting tools that allow the device to be programmed to the listener's requirements.

In one embodiment of the present invention, the "master" and "slave" scenario, a master hearing aid device may be worn in one ear, store audio signals, and stream the audio signals wirelessly to a slave hearing aid device worn in the opposite ear. In this case, the user could select a sound track through a button interface on the master device which, in turn, could send a wireless signal to the slave device to allow a synchronous onset or change in device activity.

In an alternative embodiment, a third device contains the stored signals, and streams the sound signals to the hearing aid device(s) wirelessly. In these and other embodiments of the device, a remote control may be used to activate and select the appropriate audio signal. In this case, when the selection is made, the remote control may send a wireless signal to both devices to provide synchronous onset or changes in the devices' activity.

For example, in one illustrative embodiment, audio signals are stored within a device, associated with synchronization information, and outputted at substantially the same time by two ear level devices, based at least in part on the synchronization information. Two outputs at substantially the same time may be within 0.1 seconds of each other.

In contrast to the normal loudness function, when very low intensity sounds produce an exaggerated loudness, discomfort; it is most likely an example of hyperacusis. In the hyperacusis patient the threshold of loudness discomfort is inversely related to the pitch of the test sounds. Generally, sound tolerance decreases with higher frequency tinnitus. Typically the threshold of discomfort for hyperacusis patients is on the order of 20-25 decibels above threshold for low pitched sounds (200 Hertz or so) and progressively declines until it is only about 3-5 decibels or less above threshold for sounds at 10,000 Hertz and above.

Approximately 30% of patients with tinnitus require treatment for hyperacusis. This category also includes patients exhibiting phonophobia (fear or emotional reaction to certain sounds) and misophonia (dislike of certain sounds). Since an estimated 16% of all tinnitus patients have no measurable hearing impairment; other ear pathologies including hyperacusis can occur in the absence of hearing loss which suggests that hyperacusis is presumably a central processing problem. This type of sound intolerance becomes an important part of clinical evaluation and treatment.

Typically individuals who have hyperacusis can either acquire the condition gradually over a period of time or suddenly find themselves in a state of crisis. Although most hyperacusis sufferers are in their 40s and 50s, there are many younger sufferers particularly since our society has a large degree of noise exposure. Hyperacusis sound-based therapy has remained relatively static in the past thirty years, offering limited treatment options. Historically, treatment consisted of listening to pink noise via a special hearing aid sound generator. Pink noise consists of sound that decreases in amplitude with increases in frequency at a constant rate per octave (3 dB/oct). This maintains equal energy in all octaves, which accounts for the ear's logarithmic frequency representation. Since hyperacusis patients are more sensitive to high frequencies, it is most important to increase their tolerance to these frequencies.

The need for immediate tinnitus, hyperacusis, and/or hearing loss relief by creating, transmitting, storing, processing, and communicating predetermined audio signals to the ear has never been greater. There is no standardized process for evaluating and managing the tinnitus, hyperacusis, and/or hearing loss patient at most hospitals, clinics and centers. Audiometric results are printed onto an audiogram, which the audiologist discusses with the patient who is usually told to "just live with it". Currently, there is only tinnitus treatment available i.e., Tinnitus Retraining Therapy ("TRT"). Typically, licensed audiologists with training in this area perform the TRT. The TRT is a combination of sound therapy and direct counseling for tinnitus sufferers. While some success has been shown, the method of sound therapy is not well specified.

Historically, wearable devices that generate white noise or other simple sounds (e.g. bands of noise) have been used to mask tinnitus. These sound generators have also been incorporated into hearing aids to provide amplification if hearing loss is present. Although these devices can eliminate or reduce the sensation of tinnitus, when the devices are worn, most users were nonusers in six (6) months for reasons specific to cost/benefit experience to justify the inconvenience and daily discomfort of listening to uncomfortably loud white nose, the most commonly used masking signal.

Contrary, wearable devices (e.g., Viennatone, Starkey Laboratories) that generate pink noise to retrain the hyperacusis ear have not been incorporated into hearing aids to provide amplification if hearing loss is present. This device limits the extent to which the hearing-impaired/hyperacusis suffer can benefit from this device. More recently, complex sounds (e.g. music tracks, pleasant nature sounds) can be played through a wearable device via a CD or MP3 player. However, to date there is no device available that incorporates internally-stored complex sounds.

Sound systems attempting to provide tinnitus relief (e.g., Silentia Set, Starkey Laboratories) generally require an induction loop to interface the wearable device to an external sound player. In another regard, the Silentia Set is intended to provide tinnitus relief using a stereo system to play high-frequency noise bands or simulated sound environments (e.g. traffic sounds, babble, running water, etc.) through an induction loop in a pillow. The Silentia Set requires a wearable device with an induction coil, such as a hearing aid. Further, this device is restricted to stationary environments which limits the extent to which the tinnitus sufferer can benefit from this device.

The "sound therapy" as described in TRT, utilizes devices widely available on the market, including portable music players (e.g. mp3 players), or more preferably a wearable device such as a tinnitus masker. The application of such devices universally requires simultaneous stimulation of both ears. Tinnitus-masking and/or hyperacusis-relief systems, such as those developed by the hearing aid industry, operate without synchronization. This has not posed a problem since these devices use simple sounds, such as white noise.

On the other hand, complex sounds, such as those imitating nature like air or water, require synchronization. Currently, no widely established solution exists for the synchronized delivery of tinnitus-masking and/or hyperacusis-relief signals.

In the treatment of tinnitus, a sound device is most often prescribed for each ear. In that regard it is important that the two devices are synchronized in the initiation and change of sound files, filtering and level changes of the sounds. Current devices have not required device synchronization for several reasons. Currently available devices do not have an adaptive filter or adaptive levels. Further, some devices internally generate noise which precludes the need for synchronization. Alternatively, some external personal music players have two earphones which are inherently synchronized.

Illustrative Models for Devices to Relieve Tinnitus, Hyperacusis, and/or Hearing Loss Referring now to the drawings in which like numerals indicate like elements throughout the several figures, FIG. 1 is a block diagram illustrating one embodiment of the present invention for relieving tinnitus, hyperacusis, and/or hearing loss.

The system comprises a processor 104, a remote control device 116, a first ear level device 120*a*, and a second ear level device 120*b*. The processor 104 may be in communication with the remote control device 116, the first ear level device 120*a*, and the second ear level device 120*b*.

The processor 104, remote control device 116, first ear level device 120*a* and second ear level device 120*b* may be configured to communicate wirelessly with each other. For example, the remote control device 116 may transmit wireless signals to the processor 104. As a further example, the processor may wirelessly transmit an audio signal and accompanying synchronization information to the first ear level device 120*a* and the second ear level device 120*b*. In some embodiments, the processor 104 may transmit an audio signal to the first ear level device 120*a* and the second ear level device 120*b* through an inductive loop.

The processor 104 may execute computer-executable program instructions stored in memory, such as executing one or more computer programs for event detection. Such processors can include one or more microprocessors, ASICs, and state machines. Such processors may further comprise programmable electronic devices such as PLCs, programmable interrupt controllers (PICs), programmable logic devices (PLDs), programmable read-only memories (PROMs), electronically programmable read-only memories (EPROMs or EEPROMs), or other similar devices. The processor 104 may be any one of a variety of available microprocessors from Intel, Motorola, or other manufacturers.

The processor 104 may be powered in various ways. For example, rechargeable batteries may power the processor 104.

The processor 104 may comprise a memory 110. Audio signals may be stored on the memory 110. The processor 104 may also be configured to receive an audio signal. The audio signal may be received from a microphone 108. In embodiments of the present invention, the microphone comprises a directional microphone, in contrast to an omni-directional microphone, to provide a more effective signal-to-noise ratio of the audio signal.

In other embodiments, the processor 104 may also be configured to receive an audio signal from other sources. For example, the processor 104 may receive the audio signal from other devices such as a phone, or a computer. Further, the processor 104 may be integrated into other assistive devices, such as TDDs or assistive pillows.

Alternatively, in some embodiments, the processor 104 receives an audio signal from other audio sources, such as a Bluetooth enabled device, a stereo system, a CD player or mp3 player.

The processor 104 may comprise a programmable filter 112. The processor may manipulate the audio signal with the programmable filter 112. For example, the programmable filter 112 may be configured to shape the time, spectrum, frequency, or intensity of the audio signal.

The Processor 104 may comprise one or more transceivers. As shown in FIG. 1, the processor 104 comprises a first transceiver 114*a* and a second transceiver 114*b*.

Each transceiver 114 may be in communication with a corresponding transceiver in an ear level device. For example, as shown in FIG. 1, the transceiver 114*a* of the processor 104 may be in communication with the transceiver 114*c* of the ear level device 120*a*. Likewise, the transceiver 114*b* of the processor 104 may be in communication with the transceiver 114*d* of the ear level device 120*b*. A processor configured with two transceivers 114 may be further configured to provide a stereo feed of an audio signal to dual ear level devices.

The processor 104 may be configured to receive a signal from the remote control device 116. The signal from the remote control device 116 may comprise a signal indicating which audio track a user wants to hear. For instance, a user may press a button on the remote control device 116, which sends a signal to the processor indicating a particular audio signal.

The processor 104 may be configured to log information related to its use. For example, the processor 104 may store information related to how often a user listens to a stored sound, which stored sounds the user is listening to, when the user is listening to stored sounds, or when the user is using the hearing aid option.

The processor 104 may be further configured to provide this data to an external device. For example, an audiologist may automatically download the information when the processor is reconfigured.

Each ear level device may comprise a transceiver. As shown in FIG. 1, the first ear level device 120*a* comprises a transceiver 114*c*, and the second ear level device 120*b* comprises a transceiver 114*d*.

The first ear level device 120*a* and the second ear level device 120*b* may be in communication with each other. Communication between the ear level devices may be facilitated through the transceivers in each ear level device, 114*c* and 114*d*.

The first ear level device 120*a* and the second ear level device 120*b* may be configured to receive an audio signal from the processor 104.

The first ear level device 120*a* and the second ear level device 120*b* may be configured to output an audio signal at substantially the same time. As an example, substantially the same time may mean reproduction of the signals within 0.1 second of each other. That is, the first ear level device 120*a* may output the audio signal within 0.1 seconds of the second earl level device 120*b*'s output of the audio signal.

Figure 2:
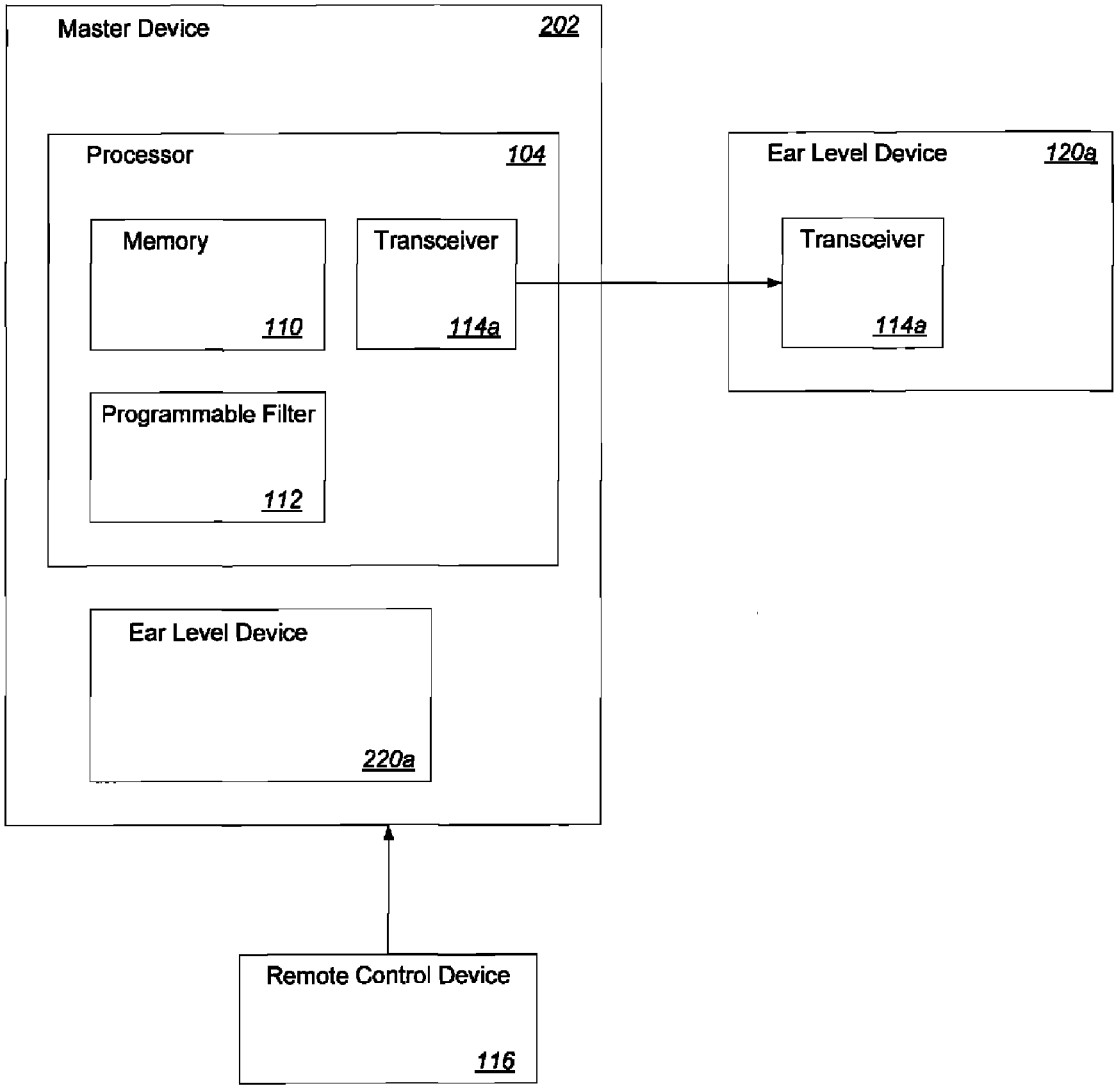
FIG. 2 is a block diagram illustrating a second embodiment of the tinnitus, hyperacusis, and/or hearing loss relieving device.

FIG. 2 is a block diagram illustrating a second embodiment of the present invention for relieving tinnitus, hyperacusis, and/or hearing loss.

In FIG. 2, the first ear level device 120*a* may be configured as the master. The master ear level device 202 may comprise the processor 104.

The master ear level device 202 may further comprise the memory 104.

When the first ear level device 120*a* may be configured as a master, the first ear level device 120*a* may be in communication with the remote control device 116 and the second ear level device 120*b*.

The master ear level device 202 may further comprise a track selector 206. The track selector may be configured as a button interface. For instance, the user may select an audio track on the master ear level device 202 by pressing a button on the track selector 206. The master ear level device 202 may respond to a user selection by sending a signal to the slave device, which may yield the synchronous onset or change in device activity.

Figure 3:
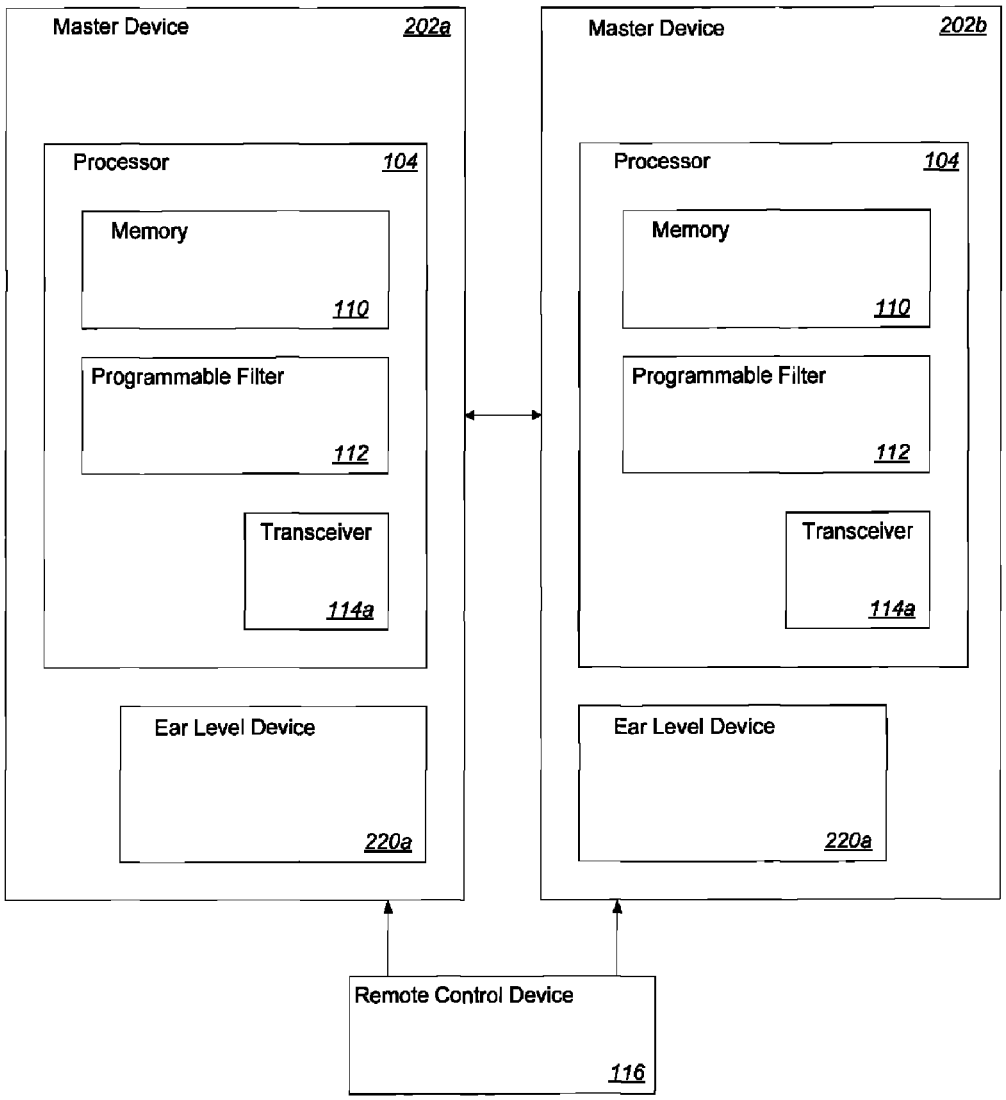
FIG. 3 is a block diagram illustrating a third embodiment of the tinnitus, hyperacusis, and/or hearing loss relieving device.

FIG. 3 is a block diagram illustrating a third embodiment of the present invention for relieving tinnitus, hyperacusis, and/or hearing loss.

In FIG. 3, both the first ear level device and the second ear level device are configured as master devices.

In an embodiment such as the one shown in FIG. 3, a user may be able to select an audio signal on either device. Once the user selects an audio signal on one of the master devices, that master device may then send a wireless signal to the other master device to allow a synchronous onset or change in the device activity.

Figure 4A:
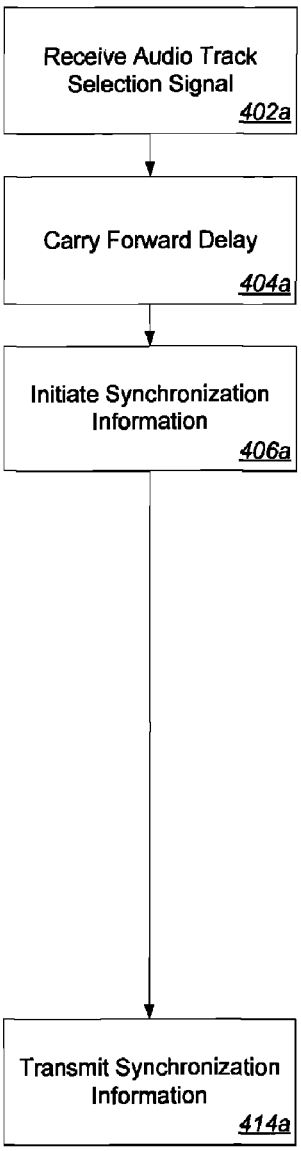
FIGS. 4A, 4B, and 4C are flowcharts illustrating embodiments of methods for relieving tinnitus, hyperacusis, and/or hearing loss.
Figure 4B:
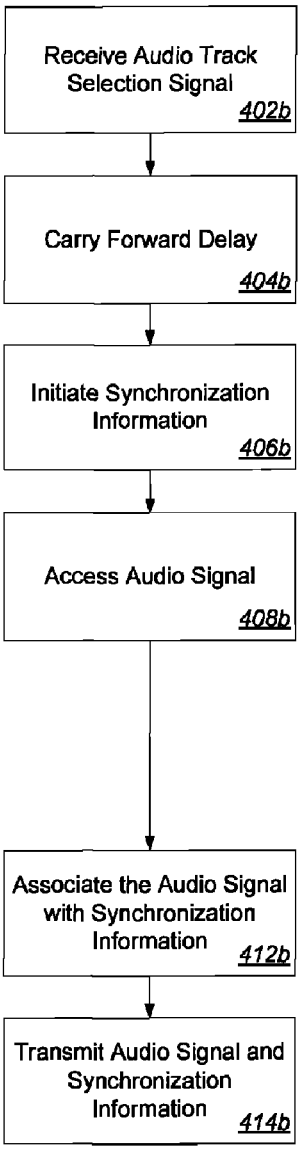
Figure 4C:
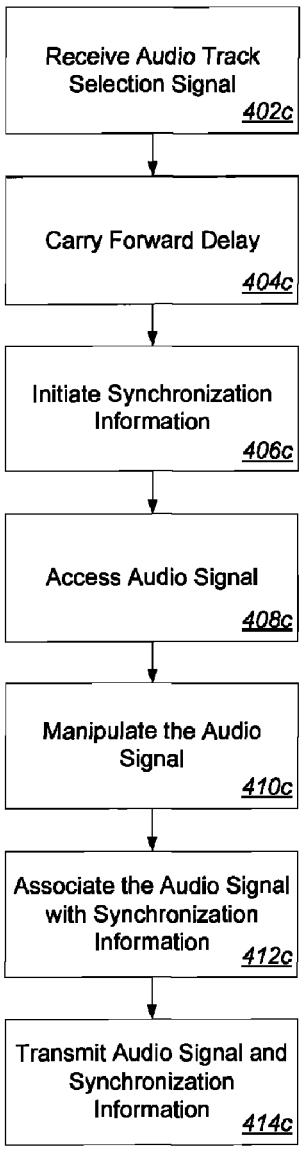

Illustrative Models for Methods to Relieve Tinnitus, Hyperacusis, and/or Hearing Loss FIGS. 4*a*, 4*b*, and 4*c* are flowcharts illustrating three embodiments of the method for relieving tinnitus, hyperacusis, and/or hearing loss.

In steps 402*a*, 402*b*, and 402*c*, an audio track selection signal may be received. A processor such as processor 104 may receive the track selection signal.

In various embodiments, the track selection signal may originate from various devices. The track selection signal may be sent from a remote control device 116. Specifically, the user may press a button on the remote control, causing a track selection signal to be transmitted. Alternatively, a user may press a button on a master ear level device 202, which may generate a track selection signal.

Once the audio selection signal has been received, a carry forward delay may be generated 404*a*, 404*b*, and 404*c*. The carry forward delay may prevent a stored audio signal from playing until several seconds after a user selects an audio signal 402*a*, 402*b*, 402*c*. For instance, the carry forward delay may cause the output of the audio signal to be delayed by 2-3 seconds. In other embodiments, there may be a smaller carry forward delay. In some embodiments, there may be no carry forward delay (a delay of 0 seconds). By delaying the output of sound, the carry forward delay may prevent abrupt and unwanted output of sounds when a user selects a different audio signal.

In step 406*a*, 406*b*, 406*c*, synchronization information may be initiated. The synchronization information may contain information regarding changes made to the first ear level device that will also be made to the second ear level device. For instance, such changes may include the initiation of an audio signal output, or the audio signal to be played.

In step 408*b*, 408*c*, the selected audio signal may be accessed on the device. The audio signal accessed may based on the selection signal received 402*b*, 402*c*. In some embodiments of the invention, the processor may access an audio signal stored in memory 110. In other embodiments of the invention, the processor may access an environmental sound captured by a microphone.

In step 410*c*, the audio signal may be manipulated. A processor 104 may manipulate the audio signal 410*c* via the filter characteristics on a programmable filter 112. The audio signal may be manipulated by fluctuating one or more of the spectrum, time, frequency, or intensity characteristics of the audio signal.

In steps 412*b*, 412*c*, the audio signal may be associated with synchronization information. For example, a processor 104 may associate the audio signal with synchronization information.

In step 414*a*, the synchronization information may be transmitted. A processor 104 may transmit the synchronization information 414*a* via a transceiver 114.

In steps 414*b*, 414*c*, the audio signal and the synchronization information are transmitted. In steps 414*b* or 414*c*, two audio signals may be transmitted by a processor 104 via two transceivers 114*a* and 114*b*. The synchronization information and the audio signal(s) may be received by the first ear level device 120*a* and the second ear level device 120*b*.

Figure 5A:
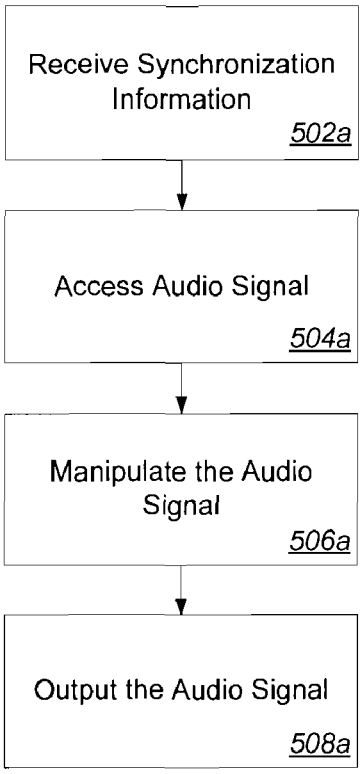
FIGS. 5A and 5B are flowcharts illustrating further embodiments of methods for relieving tinnitus, hyperacusis, and/or hearing loss.
Figure 5B:
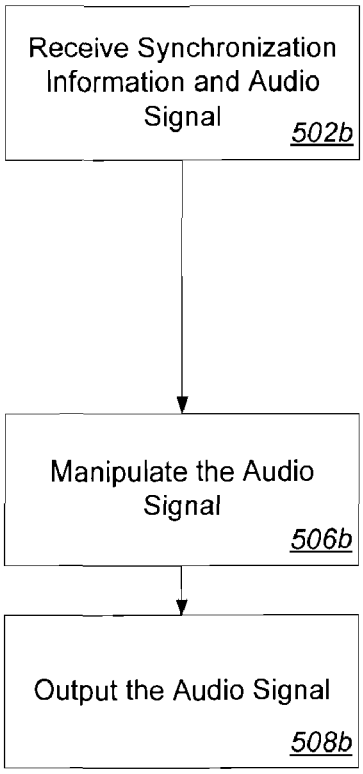

FIGS. 5A and 5B are flowcharts illustrating two embodiments of methods for relieving tinnitus, hyperacusis, and/or hearing loss. FIGS. 5A and 5B both illustrate a method utilized by a slave device.

In FIG. 5A, synchronization information may be received 502*a*. This information may be received by a slave device 220*b*. The synchronization information may not be accompanied by an audio signal.

An audio signal may then be accessed 504*a*. For example, the audio signal may be accessed from a storage device. In step 504*a*, a slave device may access an audio signal located on a storage device. In FIG. 5B, synchronization information may be received with an audio signal 502*b*.

In FIG. 5B, synchronization information and an audio signal are received 502*b* at the same time.

Once the audio signal may be accessed 504*a*, or received 502*b*, the audio signal may be manipulated 506*a* 506*b*. For instance, the filter characteristics of a programmable filter may shape the audio signal with parameters specific to a user.

The audio signal may then be outputted 508*a* 508*b*. The audio signal may be outputted to an ear level device.

Audiometric and Tinnitus or Hyperacusis Assessment

Figure 6:
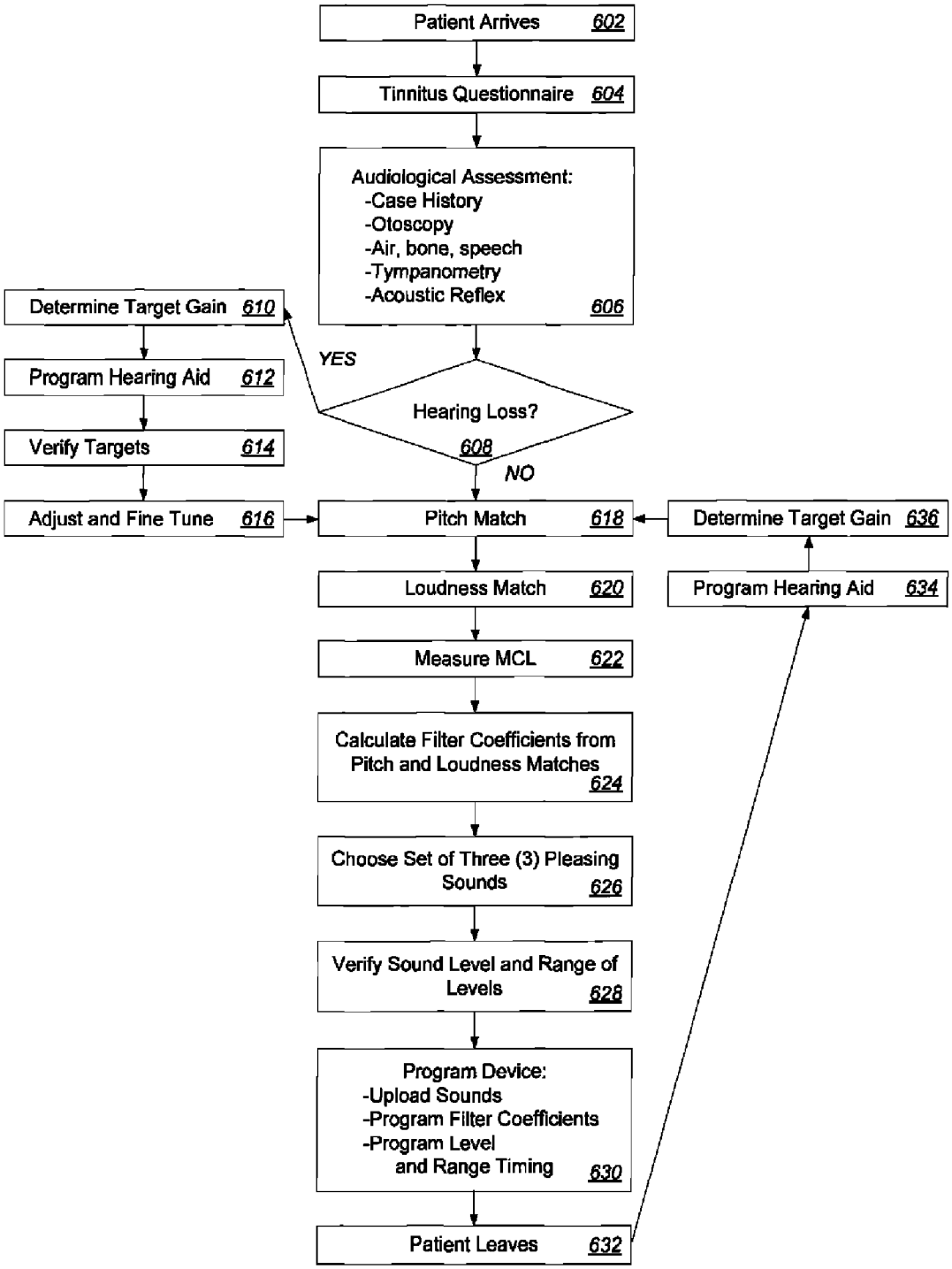
FIG. 6 is a flowchart illustrating a method for an audiometric and tinnitus assessment, which may lead to programming one embodiment of the present invention.

FIG. 6 is a flowchart illustrating a method for an audiometric and tinnitus assessment, which may lead to programming one embodiment of the present invention.

According to the patient care model as shown in FIG. 6, the tinnitus management device and methods includes the patient-care process from patient arrival 602, hearing evaluation, tinnitus evaluation and appropriate programming of the tinnitus management device. In addition, this device may be designed to meet requirements contained in Tinnitus Retraining Therapy (TRT), including direct counseling and periodic follow-up.

A tinnitus examination may be conducted at an audiology center which includes a tinnitus questionnaire 604, a comprehensive case history, and an audiological assessment 606 to determine hearing sensitivity between 250-16,000 Hz. The audiologist performing the exam typically obtains measurements of middle ear function, which also include assessment of stapedial reflex activity, which provides information about the neural integrity of a portion of the auditory pathway. The Audiologist will determine whether this is hearing loss 608.

If there is hearing loss, a target gain is determined 610. Next, the hearing aid is programmed 612. Targets for the hearing aid and the patient are then verified 614. Then, the hearing is adjusted and fine tuned 616.

In the absence of hearing impairment, where the audiologist has obtained results from the audiological examination, the audiologist in one aspect may obtain new psychophysical information to perform a multi-dimensional analysis, (i.e. frequency, intensity sound type, residual dynamic range, etc.) of the tinnitus to convert the tinnitus-matching data into a format to window the frequency-bandwidth(s) to enhance tinnitus masking and distract hearing attention away from the tinnitus. Hence, the user can reference his/her tinnitus-pitch match 618, using an ascending-descending frequency-matching technique (for the average of two out of three trials). Once determined, the same format is followed to obtain an intensity-loudness match 620. This ensures that a most comfortable listening (MCL) level is determined for pitch-range and loudness, and the settings are stored on the memory chip and transferred to the device of the invention. Once the pitch match and loudness matches have been performed, the MCL is then measured 622.

These features are not presently available, which again represents the method employed in the present invention to determine the filter coefficients of the stored audio files that maintain the pleasant characteristics of the audio signal. The invention describes a programmable band-pass digital filter algorithm with nominal levels programmed to the user's MCL. A personal computer with proprietary software calculates the filter coefficients 624. A set of three pleasing sounds is chosen 626. Before the sounds are transferred, the sound level and range of levels is verified 628. Then, the filter parameters are programmed, and a set of three pleasant audio-listening sound files may be uploaded 630. Once the device is programmed, the patient can leave 632.

However, a patient may report a change in tinnitus over time 634. In such a scenario, a patient may return to the audiologist for a new tinnitus questionnaire 636, followed by a pitch match 618.

Figure 7:
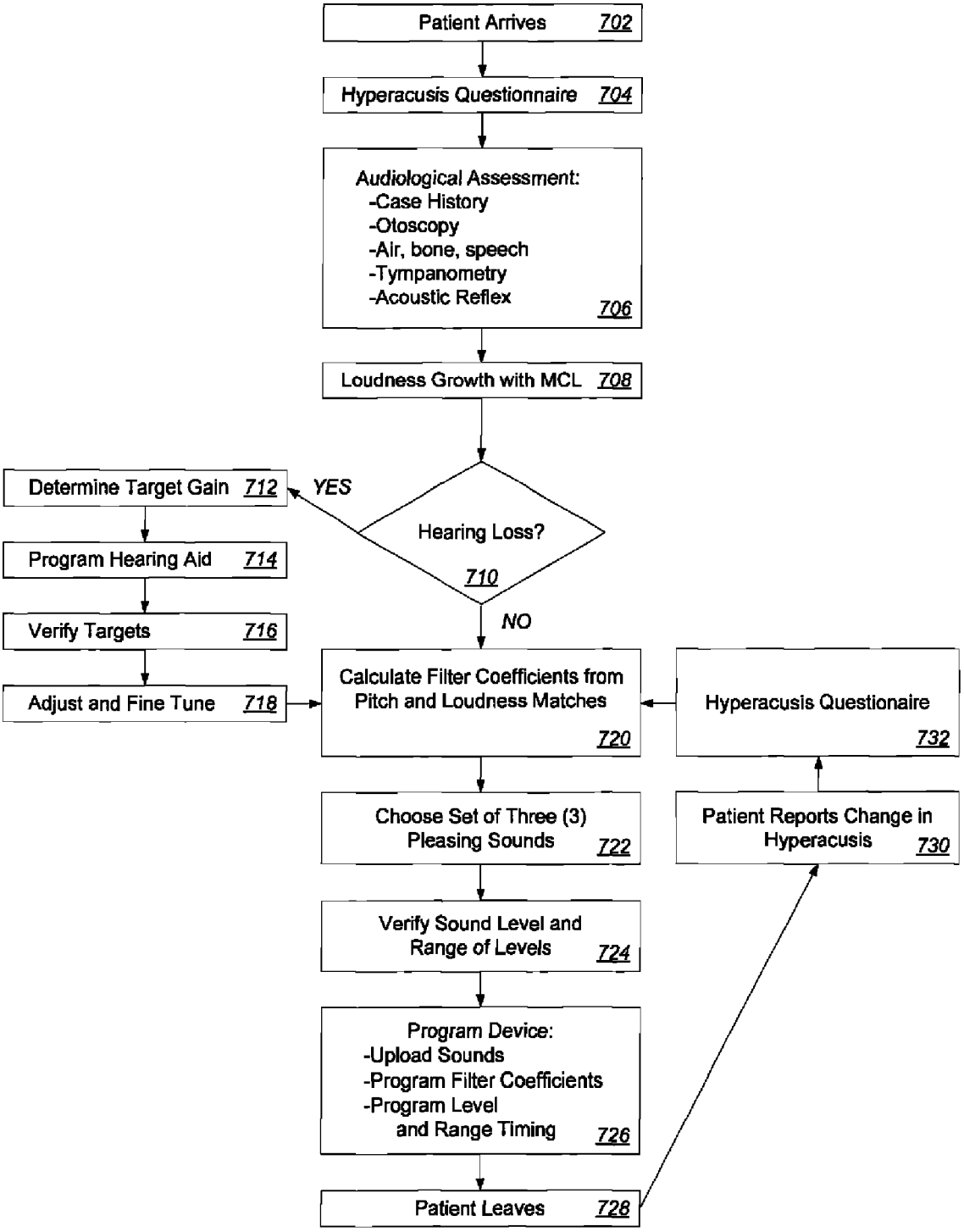
FIG. 7 is a flowchart illustrating a method for an audiometric and hyperacusis assessment, which may lead to programming one embodiment of the present invention.

FIG. 7 is a flowchart illustrating a method for an audiometric and hyperacusis assessment, which may lead to programming one embodiment of the present invention. According to the patient care model as shown in FIG. 7, the hyperacusis management device and methods includes the patient-care process from patient arrival 702, hearing evaluation, hyperacusis evaluation and appropriate programming of the hyperacusis device.

Again, one method according to one embodiment of the invention is also used in another general embodiment according to the following method, which is shown in detail in flow-chart format in FIG. 7. A hyperacusis examination is conducted (generally, two hours are scheduled for this evaluation) at an audiology center which includes a comprehensive case history and subjective questionnaires 704 designed to assess the degree of sensitivity, degree of annoyance of the primary condition, and negative effect on lifestyle. After consultation, the audiologist places the patient in one of the five general categories described by Jastreboff (1998). Evaluation of the patient includes audiological assessment 706 to determine hearing sensitivity between 250-16,000 Hz. Loudness growth measurements are made to determine MCL and LDLs pure-tone frequencies of, minimally, 500, 1 k, 2 k, 4 k, 8 k, 12 k and 16 k Hz and uncomfortable loudness levels (UCLs) using monitored live voice 708. Distortion product otoacoustic emissions tests assess the function of outer hair cells. No test is performed that will exceed the levels of the LDLs. Tests such as tympanometry, acoustic reflex thresholds, reflex decay, or auditory brainstem response be postponed until LDLs improve.

The Audiologist will determine whether this is hearing loss 710. If there is hearing loss, a target gain is determined 712. Next, the hearing aid is programmed 714. Targets for the hearing aid and the patient are then verified 716. Then, the hearing is adjusted and fine tuned 718.

In the absence of hearing impairment, the audiologist may calculate filter coefficients from pitch and loudness matches 720. Next, a set of three pleasing sounds is chosen 722. Before the sounds are transferred, the sound level and range of levels is verified 724. Then, the filter parameters are programmed, and a set of three pleasant audio-listening sound files may be uploaded to the device 726. Once the device is programmed, the patient can leave 728.

However, a patient may later report a change in hyperacusis 730. In such a scenario, a patient may return to the audiologist for a new hyperacusis questionnaire 732, followed by a loudness growth with MCL 708.

Manipulating an Audio Signal

Figure 8:
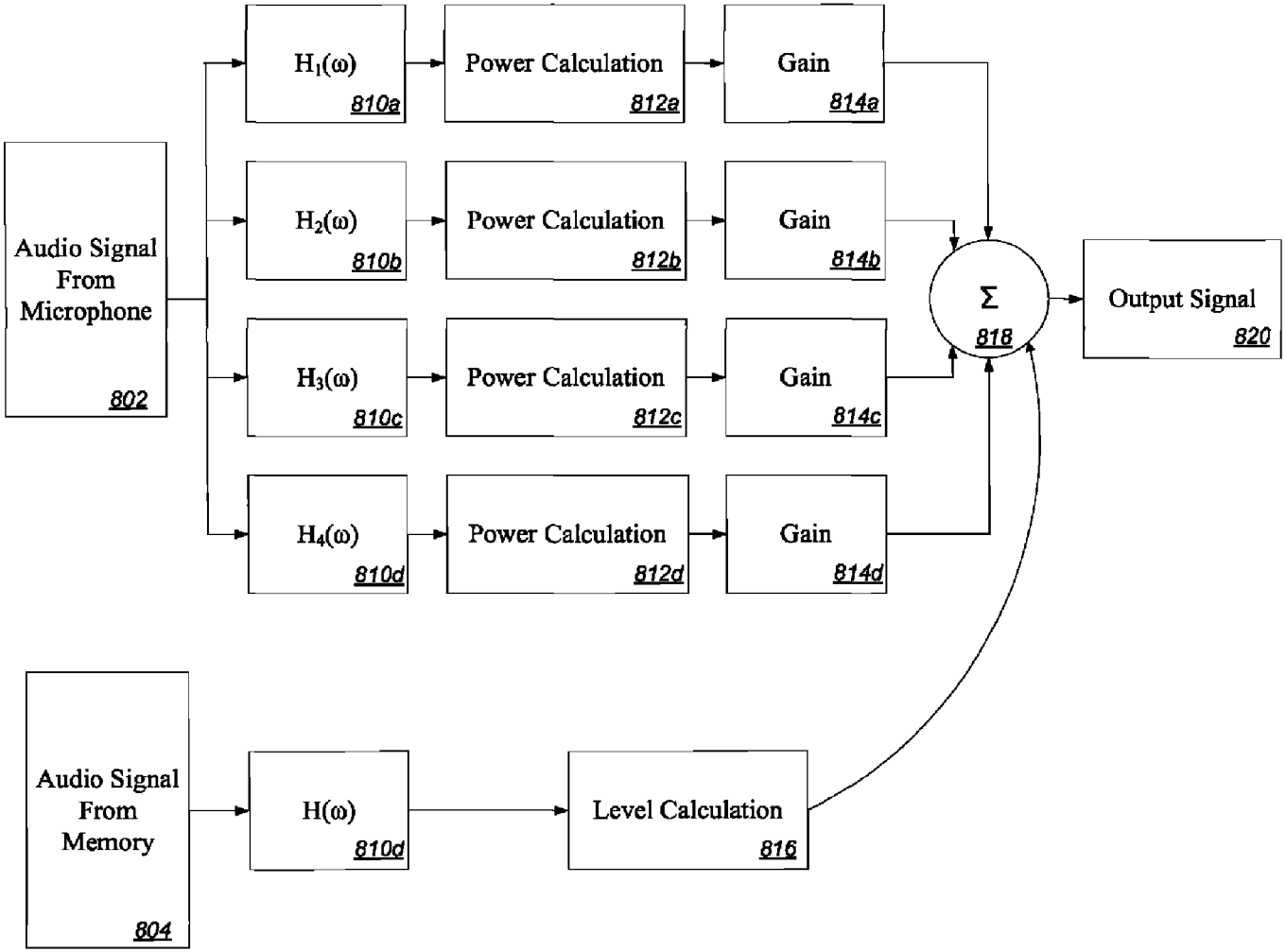
FIG. 8 is a flowchart illustrating manipulation of an audio signal in one embodiment of the present invention.
Figure 9:
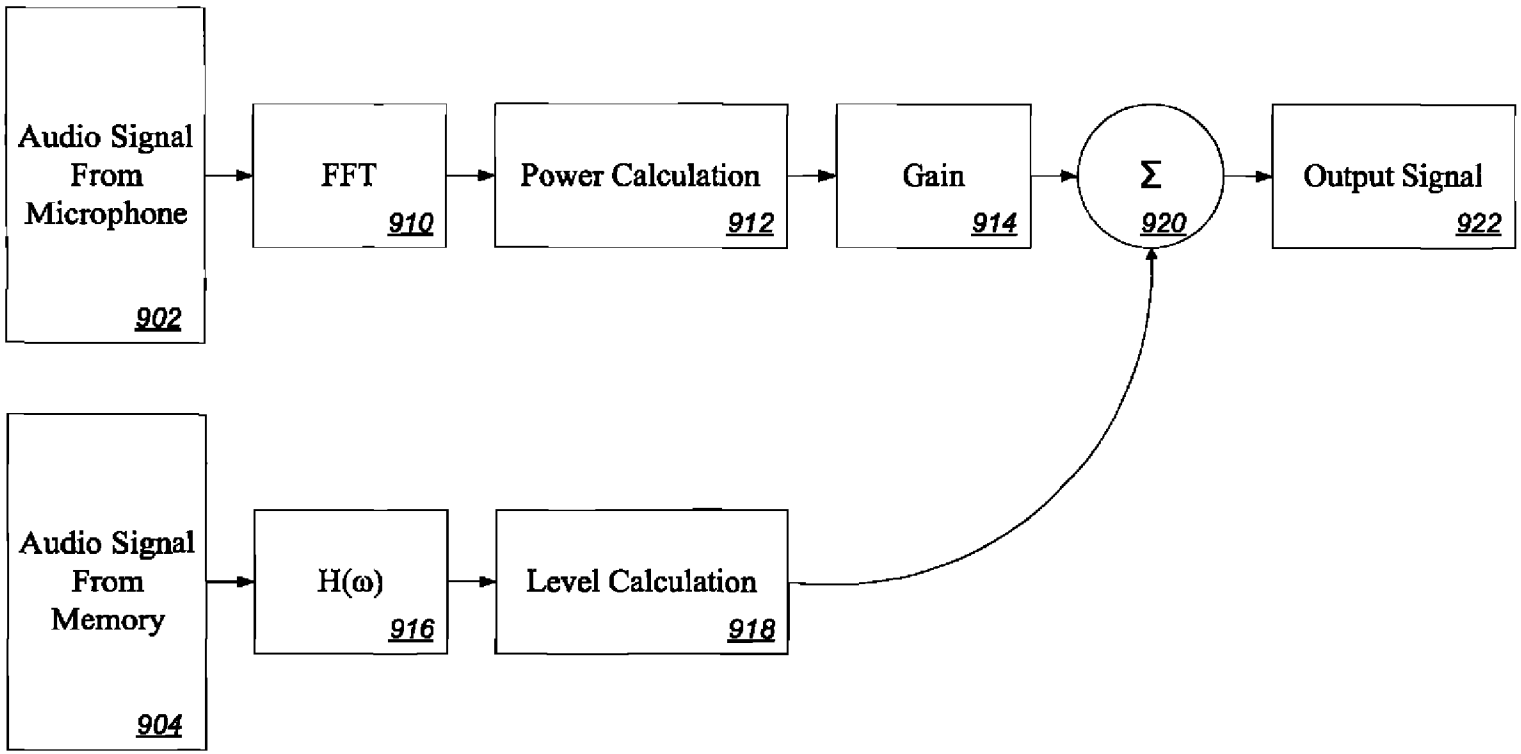
FIG. 9 is a flowchart illustrating manipulation of an audio signal in one alternative embodiment of the present invention.

FIG. 8 and FIG. 9 each illustrate two discrete signal flow paths. In each case, Track A refers to the amplification option starting at the microphone, leading to the transducer. Track B refers to the tinnitus-relief circuitry starting with an audio signal stored in memory, leading to the transducer.

FIG. 8 is a flowchart illustrating manipulation of an audio signal in one embodiment of the present invention.

In Track A of FIG. 8, an audio signal is accessed from the microphone 802. In one aspect of the invention, the input signal is filtered into at least four separate frequency bands each with distinct gain and compression characteristics (i.e. cutoff frequencies, gain, compression kneepoint, and compression ratio), which can be selected by the audiologist and adjusted. Next, the signal is routed through a programmable filter H(ω) 810*a*, 810*b*, 810*c*, and 810*d*.

A power calculation is then done on each separate frequency band 812*a*, 812*b*, 812*c*, 812*d*. Then, each separate frequency is manipulated by a gain filter 814*a*, 814*b*, 814*c*, and 814*d*. In Track B of FIG. 8, an audio signal is accessed from memory 804. The memory storage device may store, play, and route audio signals to a programmable filter H(ω) 810*d*, the filter coefficients of which can adapt over time. The changing filter coefficients, or characteristics, may shape the spectrum of the sound to the perception of the tinnitus. Furthermore, if the filter is adaptive, the filter coefficients adapt over time changing the spectrum of the sound. Such spectrum is corrected in the "level calculation block" and set to the listeners pre-determined MCL regardless of the residual perception of the tinnitus. One aspect of the audio spectrum ensures periodic perception and masking, or alternatively, blending, of the tinnitus by increasing and decreasing the presentation level as provided in proprietary-based software.

In another aspect, most cases of sensorineural hearing loss associated with tinnitus, hyperacusis, and/or hearing loss lead to a reduction in dynamic range. Hence, the present invention maps the dynamic range to include 100 dB which takes into account the entire range of sensorineural acuity. For this reason the present invention preferably incorporates a dynamic input-output function to compress the amount of gain (in dB) which eliminates distortion and prevents unpleasant listening situations. Further, the compression requirements will have onset times from 2-50 ms and offset times 50-500 ms. Moreover, the gain requirements are derived from the input level for the individual band. The Power Calculation 812*a*, 812*b*, 812*c*, and 812*d* estimates the gain (in dB) to be included in each frequency band 814*a*, 814*b*, 814*c*, and 814*d*. In another aspect, the output(s) from the four signal paths in Track A, respectively, may be summed 818 and sent to the transceiver to create an acoustic representation of the audio signal 820.

FIG. 9 is a flowchart illustrating manipulation of an audio signal in an alternative embodiment of the present invention.

An audio signal is received from a microphone 902. A Fast Fourier Transform ("FFT") is performed 910 to represent the short-term spectrum in small, but discrete steps or points. The characteristics as determined by the gain formula are implemented, point-by-point as derived from the audiogram input to the gain characteristic. A point-by-point power calculation is performed 912. Next, a point-by-point gain is calculated for Track A 914.

An audio signal is also received from memory 904. The memory storage device may store, play, and route audio signals to a programmable filter H(ω) 916, the filter coefficients of which can adapt over time. A level calculation 918 is then performed on the audio signal from memory.

The result from Track A is summed with the result from Track B 920. The signal comprising the sum of Track A and Track B is then outputted 922, which may create an acoustic representation of the modified signal.

Figure 10:
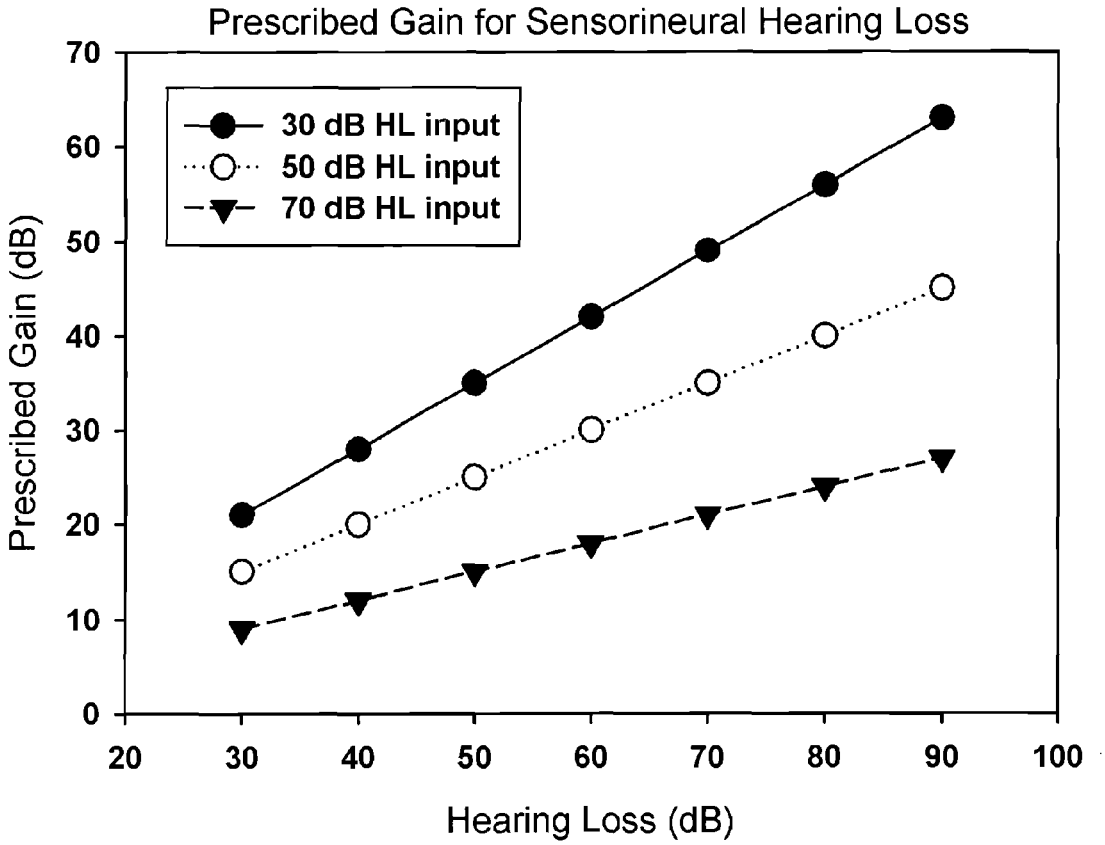
FIG. 10 is a graph illustrating the prescribed gain curves that determine the amount of gain for a given level of input and amount of hearing loss at any given frequency in one embodiment of the present invention.

FIG. 10 is a graph illustrating the prescribed gain curves that determine the amount of gain for a given level of input and amount of hearing loss at any given frequency.

The target gain for amplification is derived as follows: $G=\theta(1-I/100)$. Where G, the gain in dB, is prescribed such that it maps the user's residual dynamic range into the user's reduced dynamic range. In that regard, θ is threshold and I is the input level (in dB). According to the formula, gain estimates for different inputs (30, 50, and 70 dB HL) for various degrees of hearing loss are shown in FIG. 10.

Figure 11:
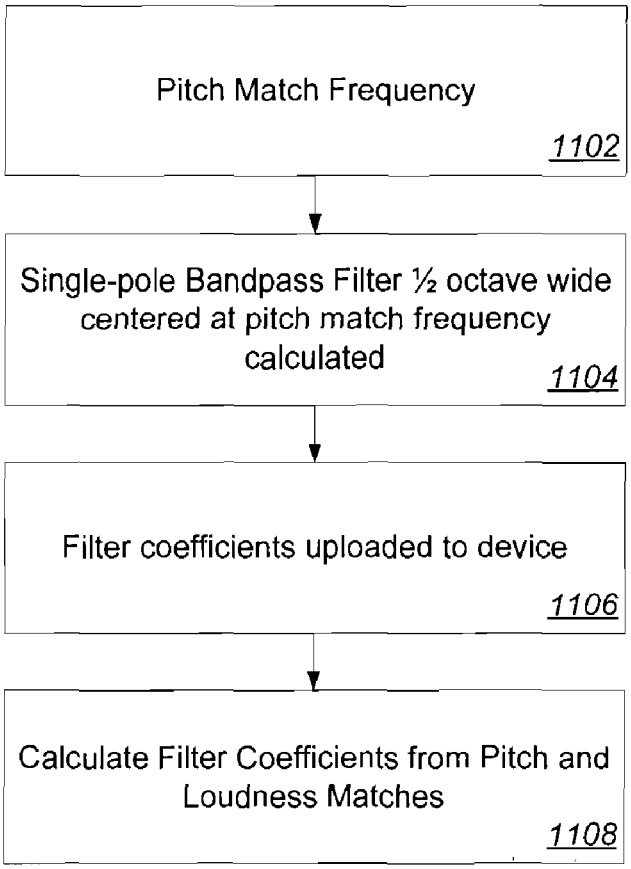
FIG. 11 is a flowchart illustrating the translation from an evaluation to the spectral filtering of the environmental complex sounds in one embodiment of the present invention.

FIG. 11 is a flowchart illustrating a method in one embodiment of the present invention for translating the tinnitus or hyperacusis evaluation to the spectral filtering of the environmental and complex sounds.

In 1102, a pitch match frequency is performed. In 1104, a single-pole bandpass filter ½ octave wide, centered at pitch, matches the frequency calculated in 1102. In 1106, the filter coefficients are uploaded to the device. In 1108, the device calculates the filter coefficients from the pitch and loudness matches.

Figure 12:
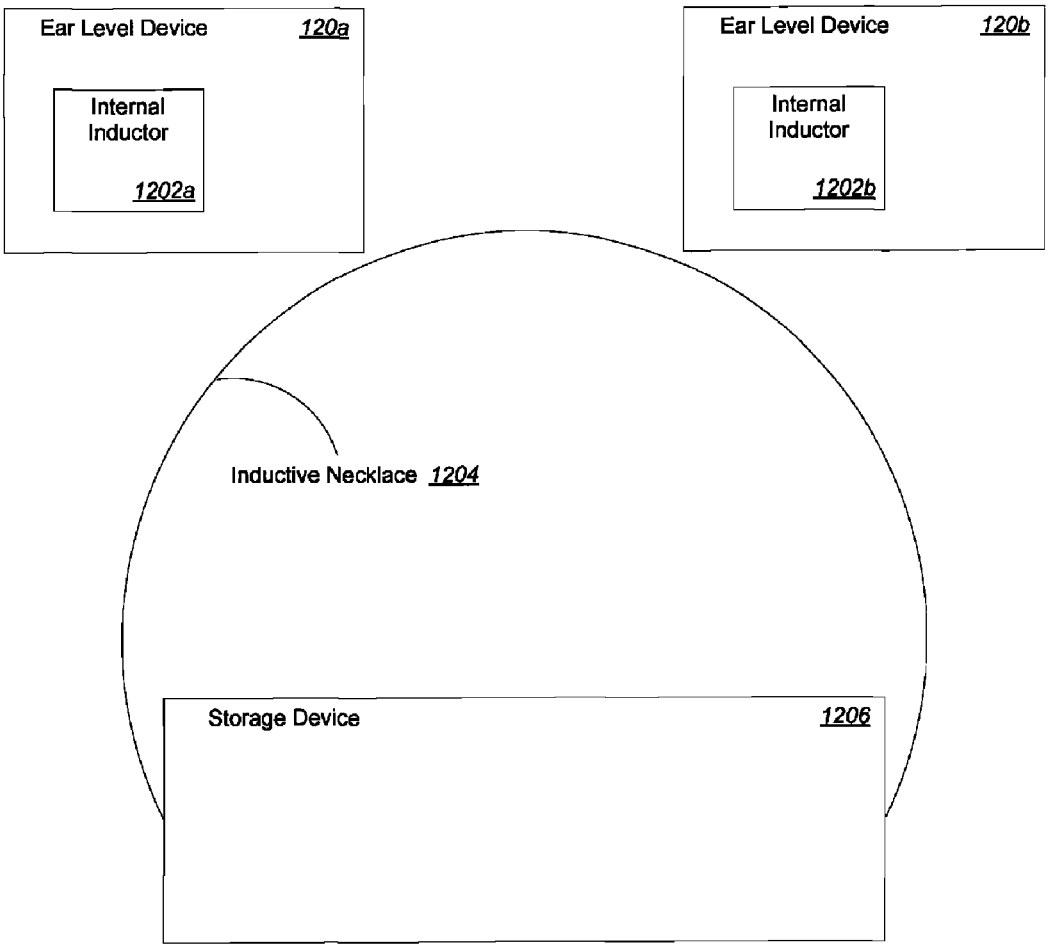
FIG. 12 is a diagram illustrating another embodiment of the tinnitus, hyperacusis, and/or hearing loss relieving device.

FIG. 12 is a diagram illustrating another embodiment of the tinnitus, hyperacusis, and/or hearing loss relieving device. The storage device 1206 plays audio signals. Each ear level device 120*a* and 120*b* may have an internal inductor 1202*a* and 1202*b*. As the audio signals are played by the storage device 1206, the ear level devices may be powered inductively as current flows through the inductive necklace 1204.

Figure 13:
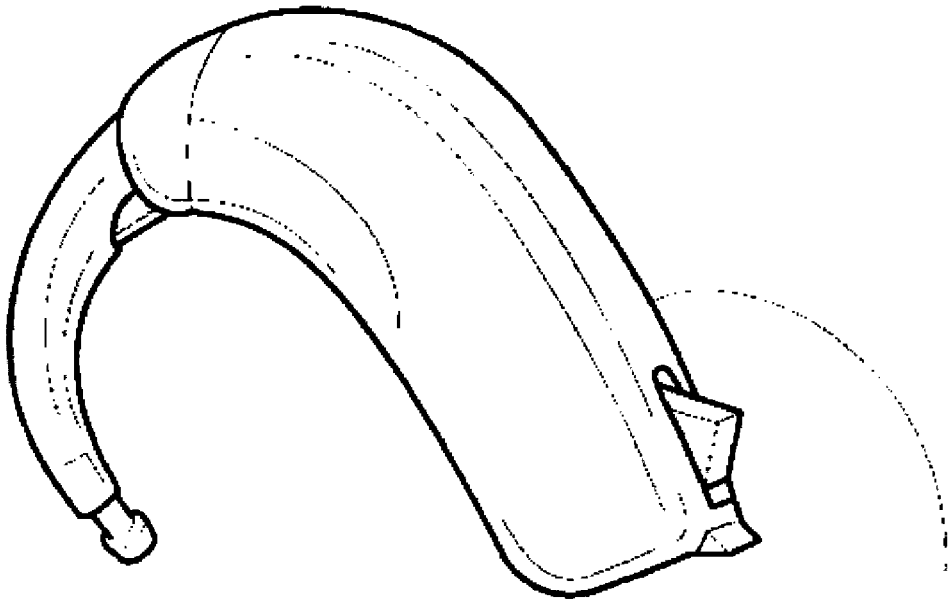
FIG. 13 is a block diagram illustrating a fourth embodiment of the tinnitus, hyperacusis, and/or hearing loss relieving device.

FIG. 13 is a diagram illustrating another embodiment of the tinnitus, hyperacusis, and/or hearing loss relieving device. As illustrated, the ear level device 1302 can fit around a user's ear.

The foregoing description of embodiments of the present invention has been presented only for the purpose of illustration and description and is not intended to be exhaustive or to limit the invention to the precise forms disclosed. Numerous modifications and adaptations thereof will be apparent to those skilled in the art without departing from the spirit and scope of the present invention.

That which is claimed is:

1. A method for relieving tinnitus, hyperacusis, or hearing loss, comprising:

(a) selecting for a user of ear level devices a plurality of stored audio signals;

(b) applying a customized filter to each of the plurality of stored audio signals;

(c) transmitting to a user device the plurality of filtered audio signals;

(d) receiving at a processor on the user device from the user a selection of one of the plurality of filtered audio signals;

(e) in response to receiving the selection of the filtered audio signal, transmitting to the ear level devices synchronization information for transmitting the filtered audio signal to the ear level devices;

(f) associating with the filtered audio signal the ear level device synchronization information;

(g) transmitting to a first ear level device and a second ear level device:

(i) the filtered audio signal; and (ii) the associated ear level device synchronization information;

to cause the first ear level device and the second ear level device, to output the filtered audio signal substantially simultaneously.

2. The method of claim 1 wherein the stored audio signal comprises environmental sounds received through a microphone.

3. The method of claim 1 wherein applying the customized filter to the stored audio signals comprises: 1) identifying filter coefficients; and 2) entering the filter coefficients in a programmable filter.

4. The method of claim 1 wherein applying a customized filter to the stored audio signals comprises mixing a first audio signal with a second audio signal.

5. The method of claim 1 further comprising applying at the processor to the filtered audio signal a programmable adaptive filter that changes one or more of a length, a frequency, or an intensity level of the filtered audio signal.

6. The method of claim 5 wherein changing the length, the frequency, or the intensity of the filtered audio signal is based at least in part on at least one filter characteristic.

7. The method of claim 6 wherein the at least one filter characteristic is associated with an individualized measurement.

8. The method of claim 7 wherein the individualized measurement is derived from a contemporary audiological assessment protocol.

9. The method of claim 6 wherein the at least one filter characteristic changes over time.

10. The method of claim 1 wherein transmitting the filtered audio signal is delayed to prevent an audio signal from playing immediately after it is selected.

11. The method of claim 1 wherein transmitting the filtered audio signal comprises wirelessly transmitting the manipulated audio signal.

12. The method of claim 1 wherein transmitting the filtered audio signal comprises streaming the manipulated audio signal through an inductive loop.

13. The method of claim 1, further comprising logging information associated with the transmitted audio signal.

14. The method of claim 13, wherein the logging information comprises which of the plurality of filtered audio signals is played to the user, how often each of the plurality of filtered audio signals is played to the user, when one of the plurality of filtered audio signals is played to the user, and when a hearing-aid function is used.

15. The method of claim 13, wherein the logging information is later retrieved by an external device.

16. The method of claim 15, wherein the logging information is automatically retrieved by an external device.

17. A non-transitory computer-readable medium on which is encoded processor-executable program code for relieving tinnitus, hyperacusis, or hearing loss, the computer-readable medium comprising:

(a) program code to receive a user selection of one of a plurality of filtered audio signals, the filtered audio signals produced by:

(1) selecting for the user a plurality of stored audio signals;

(2) applying a customized filter to each of the plurality of stored audio signals;

(3) transmitting to a user device the filtered audio signals;

(b) program code to initiate ear level device synchronization information in response to the user selection of a filtered audio signal;

(c) program code to apply a programmable adaptive filter to the filtered audio signal to create a manipulated audio signal;

(d) program code to associate with the manipulated audio signal the ear level device synchronization information;

(e) program code to transmit to a first ear level device and a second ear level device:
  (i) the manipulated audio signal; and
  (ii) the associated ear level device synchronization information; and
(f) program code to output the manipulated audio signal substantially simultaneously in the first ear level device and the second ear level device, based at least in part on the associated ear level device synchronization information.

18. The non-transitory computer-readable medium of claim 17 further comprising program code to log information associated with the manipulated audio signal.

19. A system for relieving tinnitus, hyperacusis, or hearing loss, the system comprising:
a) a processor in communication with a first ear level device and a second ear level device, the processor configured to:
  i) receive a selection of one of a plurality of custom filtered audio signals;
  ii) in response to receiving the selection, initiating ear level device synchronization information;
  iii) apply a programmable adaptive filter to the filtered audio signal to create a manipulated audio signal; and
  iv) transmit the ear level device synchronization information and the manipulated audio signal to the first ear level device and the second ear level device;
b) the first ear level device operable to:
  i) receive the manipulated audio signal and associated ear level device synchronization information;
  ii) determine when to output the manipulated audio signal based at least in part on the associated ear level device synchronization information; and
  iii) output the manipulated audio signal; and
c) the second ear level device operable to:
  i) receive the manipulated audio signal and associated ear level device synchronization information;
  ii) determine when to output the manipulated audio signal based at least in part on the associated ear level device synchronization information; and
  iii) output the manipulated audio signal, at a substantially simultaneous time with the first device, the substantially simultaneous time based at least in part on the associated ear level device synchronization information.

20. The system of claim 19, wherein the processor is further configured to receive the filtered audio signal wirelessly from an external device.

21. The system of claim 19, wherein the processor is further configured to transmit a carry forward delay signal.

22. The system of claim 19, further comprising a remote control device, the remote control device in communication with the processor, the first ear level device, and the second ear level device, the remote control device configured to:
a) receive a user selection of a filtered audio signal and cause the—processor to activate the first ear level device and the second ear level device; and
b) transmit associated ear level device synchronization information to the first ear level device and the second ear level device.

23. The system of claim 19, wherein the first ear level device is a master and the second ear level device is a slave, the master configured to
a) store at least one audio signal;
b) select one of the at least one audio signal;
c) associate one of the at least one audio signals with ear level device synchronization information; and
d) transmit one of the at least one audio signals and the associated ear level device synchronization information to the second ear level device.

24. The system of claim 19, wherein the processor is further configured to provide power to the first ear level device and the second ear level device through an inductive loop.

25. The system of claim 19, wherein the processor comprises at least one transceiver.

26. The system of claim 19, wherein the processor is configured to interface with at least one device utilizing the hearing-aid interface protocol NOAH.

27. The system of claim 19, wherein the stored audio signal comprises environmental sound.

28. The system of claim 19, wherein the processor is physically integrated into the first ear level device.

29. The system of claim 19, wherein the first ear level device and the second ear level device comprise in-the-ear ear level devices.

30. The system of claim 19, wherein the first ear level device and the second device comprise in-the-canal ear level devices.

31. The system of claim 19, wherein the first ear level device and the second ear level device comprise completely-in-the-canal ear level devices.

* * * * *